US009661704B2

(12) United States Patent
Gyoten et al.

(10) Patent No.: US 9,661,704 B2
(45) Date of Patent: May 23, 2017

(54) SEMICONDUCTOR LIGHT SOURCE DRIVE DEVICE

(71) Applicant: Panasonic Intellectual Property Management Co., Ltd., Osaka (JP)

(72) Inventors: Takaaki Gyoten, Hyogo (JP); Shinji Miyoshi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/154,949

(22) Filed: May 14, 2016

(65) Prior Publication Data

US 2016/0353533 A1 Dec. 1, 2016

(30) Foreign Application Priority Data

May 27, 2015 (JP) ..... 2015-106935
May 6, 2016 (JP) ..... 2016-093000

(51) Int. Cl.
*H05B 33/08* (2006.01)

(52) U.S. Cl.
CPC ..... *H05B 33/0815* (2013.01); *H05B 33/0845* (2013.01)

(58) Field of Classification Search
CPC .... H05B 37/02; H05B 33/08; H05B 33/0815; H05B 33/0824; H05B 33/0851; H05B 33/0848; H05B 33/0842
USPC .... 315/186, 193, 209 R, 291, 294, 307, 308
See application file for complete search history.

(56) References Cited

U.S. PATENT DOCUMENTS

2004/0124889 A1 7/2004 Koharagi et al.
2008/0258641 A1* 10/2008 Nakagawa ..... H05B 33/0818 315/246
2009/0000309 A1 1/2009 Hershberger et al.
2009/0295776 A1* 12/2009 Yu ..... H05B 33/0818 345/212

(Continued)

FOREIGN PATENT DOCUMENTS

JP 2000-022224 A 1/2000
JP 2004-147435 5/2004

(Continued)

*Primary Examiner* — Thai Pham
(74) *Attorney, Agent, or Firm* — McDermott Will & Emery LLP

(57) ABSTRACT

A semiconductor light source drive device includes a semiconductor light source; a switching element that controls a current flowing through the semiconductor light source by being on/off-controlled by a PWM signal provided to the control end; a current detection element that detects a current flowing through the semiconductor light source; a switching power source that supplies power supply voltage to a series connection of the semiconductor light source, the switching element, and the current detection element; a PWM supply circuit supplies the PWM signal and its on-time ratio information; a target value setting part converts the on-time ratio information to a target average current value and outputs the target average current value; and a comparator compares the target average current value with an average current value detected by the current detection element and outputs comparison output to the switching power source as a signal for control.

5 Claims, 6 Drawing Sheets

(56) References Cited

U.S. PATENT DOCUMENTS

| | | | | |
|---|---|---|---|---|
| 2010/0133109 | A1* | 6/2010 | Cohen | B81C 1/00293 205/118 |
| 2013/0008488 | A1 | 1/2013 | Holmes et al. | |
| 2013/0014796 | A1 | 1/2013 | Tajima | |
| 2013/0306141 | A1 | 11/2013 | Nobori | |
| 2015/0076999 | A1* | 3/2015 | Malinin | H05B 33/0815 315/186 |
| 2015/0264760 | A1* | 9/2015 | Gyoten | H05B 33/0815 353/85 |

FOREIGN PATENT DOCUMENTS

| | | | |
|---|---|---|---|
| JP | 2007-103793 | A | 4/2007 |
| JP | 2010-532577 | A | 10/2010 |
| WO | 2011/118341 | A1 | 9/2011 |
| WO | 2012/143003 | A2 | 10/2012 |
| WO | 2012/160765 | A1 | 11/2012 |

* cited by examiner

Current waveforms in case of the on-time ratio is changed with a constant power source voltage The relationship between the on-time ratio and the average current
(Constant voltage of switching power source)

The relationship between the on-time ratio and the average current

Current waveforms in case of the on-time ratio is changed with a constant current peak value

SEMICONDUCTOR LIGHT SOURCE DRIVE DEVICE

BACKGROUND

1. Technical Field

The present disclosure relates to a semiconductor light source drive device that supplies a semiconductor light source with a drive current modulated by a high-speed pulse width.

2. Description of the Related Art

Patent literature 1 discloses a circuit for driving a light-emitting element (e.g., an LED) that outputs a constant level of pulse current limitedly affected by fluctuation of temperature and power supply voltage, and variations of elements.

The driving circuit includes a switch that turns on and off power supplied from a switching power source to a drive target; a detecting means that detects a current having flown to the drive target and outputs a detection signal corresponding to the detection result; and an error signal generation means that generates an error signal corresponding to an error between the detection signal output from the detecting means and a target signal. The driving circuit further includes a signal retaining means, which, when the switch is on, averages error signals generated by the error signal generation means; when the switch turns from on to off, retains the averaged error signal; and when the switch turns from off to on, starts averaging error signals with the retained signal level being the initial level. When the switch is off, the driving circuit stops supplying power from the switching power source to the drive target. When the switch is on, the driving circuit controls power supplied from the switching power source to the drive target in response to the error signal averaged by the signal retaining means.

This configuration provides a drive circuit that outputs a constant level of pulse current limitedly affected by fluctuation of temperature and power supply voltage, and manufacturing variations of elements.

CITATION LIST

Patent Literature

PTL 1 Japanese Patent Unexamined Publication No. 2004-147435

SUMMARY

The disclosure provides a semiconductor light source drive device that has a high power efficiency, is capable of high-speed pulse-width modulation, makes an average current value rapidly converge when the on-time ratio for pulse-width modulation is changed, and accurately controls the average current during pulse-width modulation.

A semiconductor light source drive device of the disclosure includes a semiconductor light source; a switching element that controls a current flowing through the semiconductor light source by being on/off-controlled by a PWM (pulse width modulation) signal provided to the control end; a current detection element that detects a current flowing through the semiconductor light source; a switching power source that supplies power supply voltage to a series connection of the semiconductor light source, the switching element, and the current detection element; a PWM supply circuit; a target value setting part; and a comparator. The PWM supply circuit supplies the PWM signal and on-time ratio information about the PWM signal. The target value setting part converts the on-time ratio information supplied from the PWM supply circuit to a target average current value and outputs the target average current value. The comparator compares the target average current value from the target value setting part with an average current value detected by the current detection element and outputs comparison output to the switching power source as a signal for control.

The disclosure is effective for providing a semiconductor light source drive device that has a high power efficiency, is capable of high-speed pulse-width modulation, makes an average current value rapidly converge when the on-time ratio for pulse-width modulation is changed, and accurately controls the average current during pulse-width modulation.

DETAILED DESCRIPTION OF THE PREFERRED EMBODIMENTS

Hereinafter, a detailed description is made of some exemplary embodiments referring to the related drawings as appropriate. However, a detailed description more than necessary may be omitted, such as a description of a well-known item and a duplicate description for a substantially identical component, to avoid redundant description and to allow those skilled in the art to easily understand the following description.

The accompanying drawings and the following description are provided for those skilled in the art to well understand the disclosure and are not intended to limit the subjects described in the claims.

It should be noted that the drawings are schematic and the ratios of dimensions are different from actual ones. Accordingly, specific dimensions must be determined in consideration of the following description. In addition, relations or ratios among such dimensions may be obviously different from one drawing to another.

First Exemplary Embodiment

Hereinafter, a description is made of the first embodiment using FIGS. 1 through 3.

[1-1] Configuration

Figure 1:
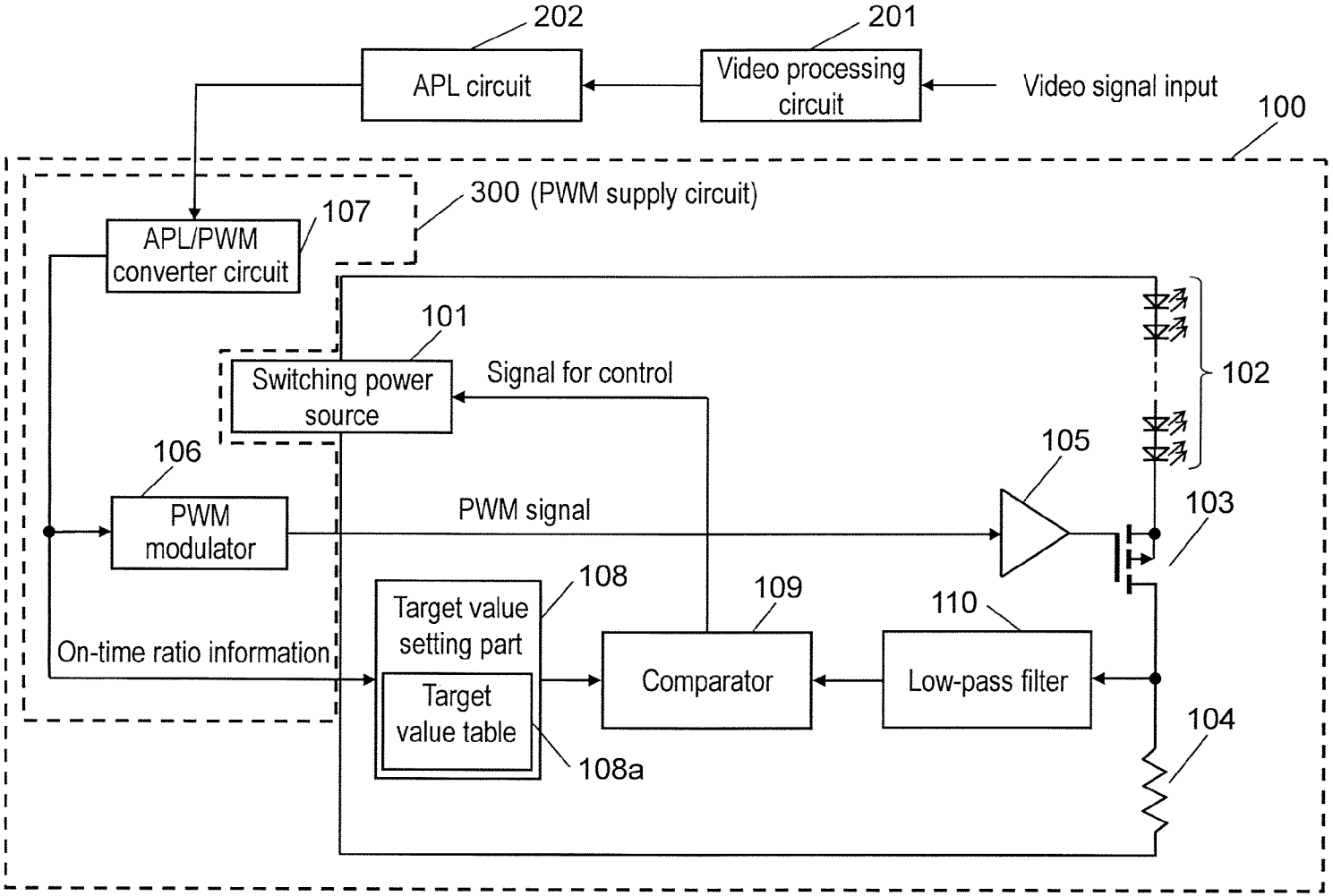
FIG. 1 is a main part block diagram illustrating the configuration of a semiconductor light source drive device according to the first exemplary embodiment.

First, a description is made of the configuration of semiconductor light source drive device 100 according to the first embodiment referring to FIG. 1.

FIG. 1 is a main part block diagram illustrating the configuration of the semiconductor light source drive device of the first embodiment when used for a projection image display apparatus. The part enclosed by the broken line in FIG. 1 is semiconductor light source drive device 100 of the embodiment. Video processing circuit 201 and APL (average picture level) circuit 202 are inside the projection image display apparatus. Video processing circuit 201 feeds a video signal to APL circuit 202, which then generates an APL signal to feed it to APL/PWM converter circuit 107 of semiconductor light source drive device 100. As shown in FIG. 1, semiconductor light source drive device 100 includes switching power source 101, PWM modulator 106, APL/PWM converter circuit 107, target value setting part 108, comparator 109, and low-pass filter 110.

Switching power source 101 outputs a DC power supply voltage. A series connection of multiple semiconductor laser diodes 102 that emit blue light, the connection between the source and drain of FET (field-effect transistor) 103, and current detection resistor 104 are series-connected to between both ends of switching power source 101. Semiconductor laser diode 102 that emits blue light is an example of a semiconductor light source, FET 103 is an example of a switching element and current detection resistor 104 is an example of a current detection element. Examples of FET 103 include a P-channel MOS-FET.

FET driver 105 on/off-drives FET 103 according to a PWM signal fed from PWM modulator 106.

APL/PWM converter circuit 107 converts an APL signal having been input to on-time ratio (duty) information for PWM control and outputs the resulting value. On-time ratio information output from APL/PWM converter circuit 107 is input to PWM modulator 106, which generates a PWM signal on the basis of the on-time ratio information. APL/PWM converter circuit 107 and PWM modulator 106 are an example of PWM supply circuit 300.

On-time ratio information output from APL/PWM converter circuit 107 is also input to target value setting part 108. Target value setting part 108 has target value table 108*a* that stores target average current values corresponding to on-time ratio information being input and outputs the target average current value to comparator 109. In other words, target value setting part 108 converts on-time ratio information from APL/PWM converter circuit 107 to a target average current value and outputs the resulting value.

Low-pass filter 110 averages values of a current flowing through semiconductor laser diode 102 detected by current detection resistor 104 and outputs the average current value to comparator 109.

Comparator 109 compares the target average current value from target value setting part 108 with the average current value from low-pass filter 110 and supplies the comparison result to the control end (unillustrated) of switching power source 101 as a signal for control. This controls the voltage output from switching power source 101 so that the target average current value from target value setting part 108 becomes equal to the average current value from low-pass filter 110.

[1-2] Operation

Hereinafter, a description is made of operation of semiconductor light source drive device 100 configured as above.

In FIG. 1, semiconductor laser diode 102, FET 103, and current detection resistor 104 are series-connected and the connection is connected to between the output ends of switching power source 101. Such a series connection causes a current of the same value to flow through current detection resistor 104 and semiconductor laser diode 102, and the current waveform is detected between both ends of current detection resistor 104 as a voltage.

This current detected by current detection resistor 104 is converted to an average current value with a small amount of ripple component by low-pass filter 110 if the cutoff frequency of low-pass filter 110 is as small enough as approximately 1/10 of the cyclic frequency of a PWM signal.

On-time ratio information for PWM control having been input from APL/PWM converter circuit 107 to target value setting part 108 is converted to a target average current value corresponding to the on-time ratio information for PWM control by target value setting part 108. Target value setting part 108 will be described in detail later.

Comparator 109 compares output (a target average current value) from target value setting part 108 with output (an average current value) from low-pass filter 110 and controls voltage output from switching power source 101 so that the output values become equal to each other. Through such an operation, the average value of a current flowing through semiconductor laser diode 102 is controlled for a target average current value adaptive to on-time ratio information for PWM control being input and set target value setting part 108.

FET driver 105 on/off-controls FET 103 according to a PWM signal having been input to PWM-control a current flowing through semiconductor laser diode 102.

Figure 2:
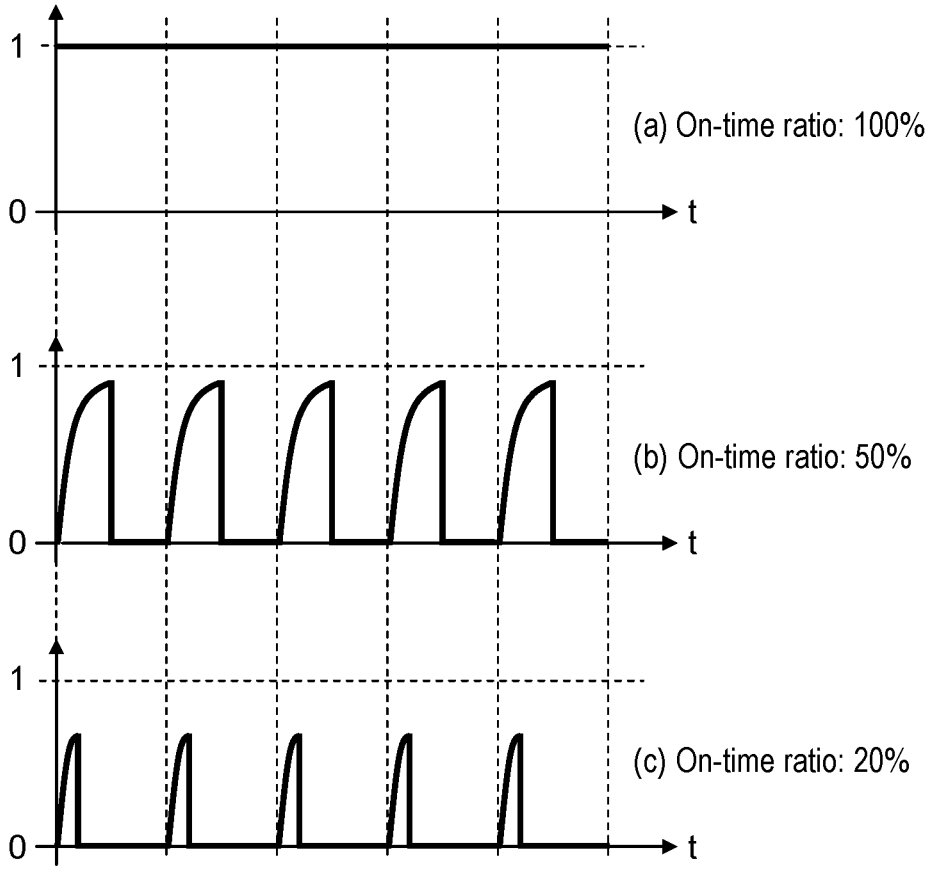
FIG. 2 is a waveform chart of a current flowing through a semiconductor laser diode for a constant voltage of the switching power source of the first embodiment.

FIG. 2 shows an example waveform of a current flowing through semiconductor laser diode 102 when the on-time ratio for PWM control is changed with the voltage output from switching power source 101 being constant. In FIG. 2, the horizontal axis represents time, and the vertical axis represents a current value normalized by a current value at an on-time ratio of 100%. FIG. 2(*a*) shows the waveform of a current flowing through semiconductor laser diode 102 at an on-time ratio of 100%; FIG. 2(*b*), 50%; and FIG. 2(*c*), 20%. As shown in FIGS. 2(*b*) and 2(*c*), if the on-time ratio is 50% and 20%, the waveform of a current flowing through semiconductor laser diode 102 is not rectangular, but actually is shaped like the teeth of a saw, where changing the on-time ratio changes the shape and maximum current value. As the on-time ratio decreases, the maximum current value reduces.

Such a phenomenon is subject to the limit of the switching speed of FET 103 to a small degree. The phenomenon occurs when the temperature at the junction of the semiconductor laser diode decreases, to increase the forward voltage of the semiconductor laser diode while a current is not flowing. That is, a voltage with an increase of the forward voltage subtracted is applied to the semiconductor laser diode immediately after being turned on to conduct a current. Subsequently, a decrease of the forward voltage due to the current flowing increases the applied voltage gradually, and so does the current value.

Figure 3:
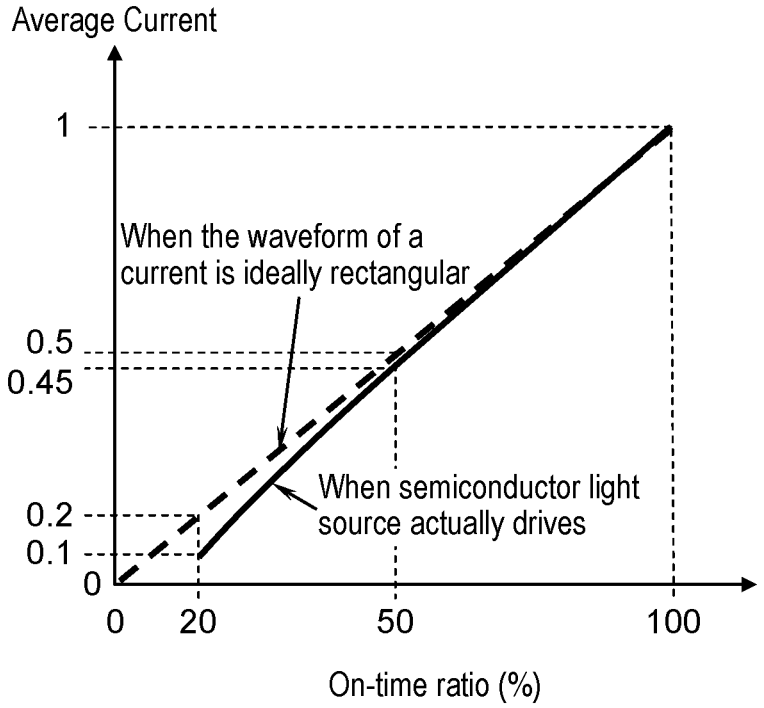
FIG. 3 is a characteristic diagram of the target value table used in the first embodiment.

FIG. 3 illustrates the characteristics of the average value of a current flowing through semiconductor laser diode 102 when the on-time ratio is changed with the voltage output from switching power source 101 being constant. In FIG. 3, the horizontal axis represents the on-time ratio, and the vertical axis represents the normalized average value of a current flowing through semiconductor laser diode 102. If the waveform of a current flowing through semiconductor laser diode 102 is ideally rectangular, the on-time ratio is proportional to the average current value as indicated by the broken line in FIG. 3. When semiconductor laser diode 102 is driven with voltage output from switching power source 101 being constant, however, the waveform of a current flowing through semiconductor laser diode 102 is shaped like the teeth of a saw as shown in FIG. 2, and the amplitude (the maximum current value) decreases, thereby reducing the average current value. Resultingly, a smaller on-time ratio causes an actual average current value smaller than that of the ideally rectangular current waveform, like the characteristics when the semiconductor light source is driven indicated by the solid line in FIG. 3.

For example, for an on-time ratio of 20%, the average current value is 0.2 for an ideally rectangular current waveform; the actual average current value is 0.1. In the same way, for an on-time ratio of 50%, the average current value is 0.5 for an ideally rectangular current waveform; the actual average current value is 0.45.

For this reason, in semiconductor light source drive device 100 according to the embodiment, target value table 108*a*, which is used for target value setting part 108 to set a target average current value, is determined using the characteristic curve when the actual semiconductor light source is driven indicated by the solid line in FIG. 3. The characteristics are values when voltage output from switching power source 101 is constant. Accordingly, if a current flowing through semiconductor laser diode 102 is feedback-controlled for a target average current value having been determined on the basis of this characteristic curve, the average value of a current flowing through semiconductor laser diode 102 accurately becomes a target average current value determined by target value setting part 108 correspondingly to the on-time ratio for PWM control being input. Besides, the voltage output from switching power source 101 can be made roughly constant except for the variation of the forward voltage of semiconductor laser diode 102. In other words, a signal for control fed from comparator 109 to switching power source 101 becomes a constant value in a steady state of switching power source 101, except that switching power source 101 undergoes feedback for compensating changes of the forward voltage of semiconductor laser diode 102.

A smoothing capacitor inserted to the output of switching power source 101 disables the output voltage value to be changed rapidly. When the voltage output from switching power source 101 is adjusted to control the average current for PWM control so as to maintain a constant value, time of approximately milliseconds is usually required before the output is stabilized. Meanwhile, semiconductor light source drive device 100 of the disclosure does not need to change the voltage output from switching power source 101, and thus is capable of stably supplying a current of a programmed waveform to semiconductor laser diode 102 rapidly.

[1-3] Advantage

In this embodiment, the average value of a current flowing through semiconductor laser diode 102 is detected by current detection resistor 104 and low-pass filter 110. Then, comparator 109 compares this average current value with a target average current value, which makes constant the voltage output from switching power source 101 corresponding to the on-time ratio for PWM control being input to target value setting part 108, to control switching power source 101.

Resultingly, the voltage output from switching power source 101 becomes roughly constant independently of the on-time ratio for PWM control, and thus the average current value rapidly converges to the target average current value even if the on-time ratio for PWM control changes. Then, the average value of a current flowing through semiconductor laser diode 102 is stabilized owing to the effect of feedback. This stabilizes light output from semiconductor laser diode 102 depending on a current flowing through semiconductor laser diode 102.

FET 103 with a low on-resistance and current detection resistor 104 with a low resistance value reduce loss caused by these devices to a very small degree. Accordingly, output from switching power source 101 can be supplied to semiconductor laser diode 102 with a small loss, thereby increasing the efficiency of the entire apparatus.

Second Exemplary Embodiment

Hereinafter, a description is made of the second exemplary embodiment using FIGS. 4 through 6.

[2-1] Configuration

Figure 4:
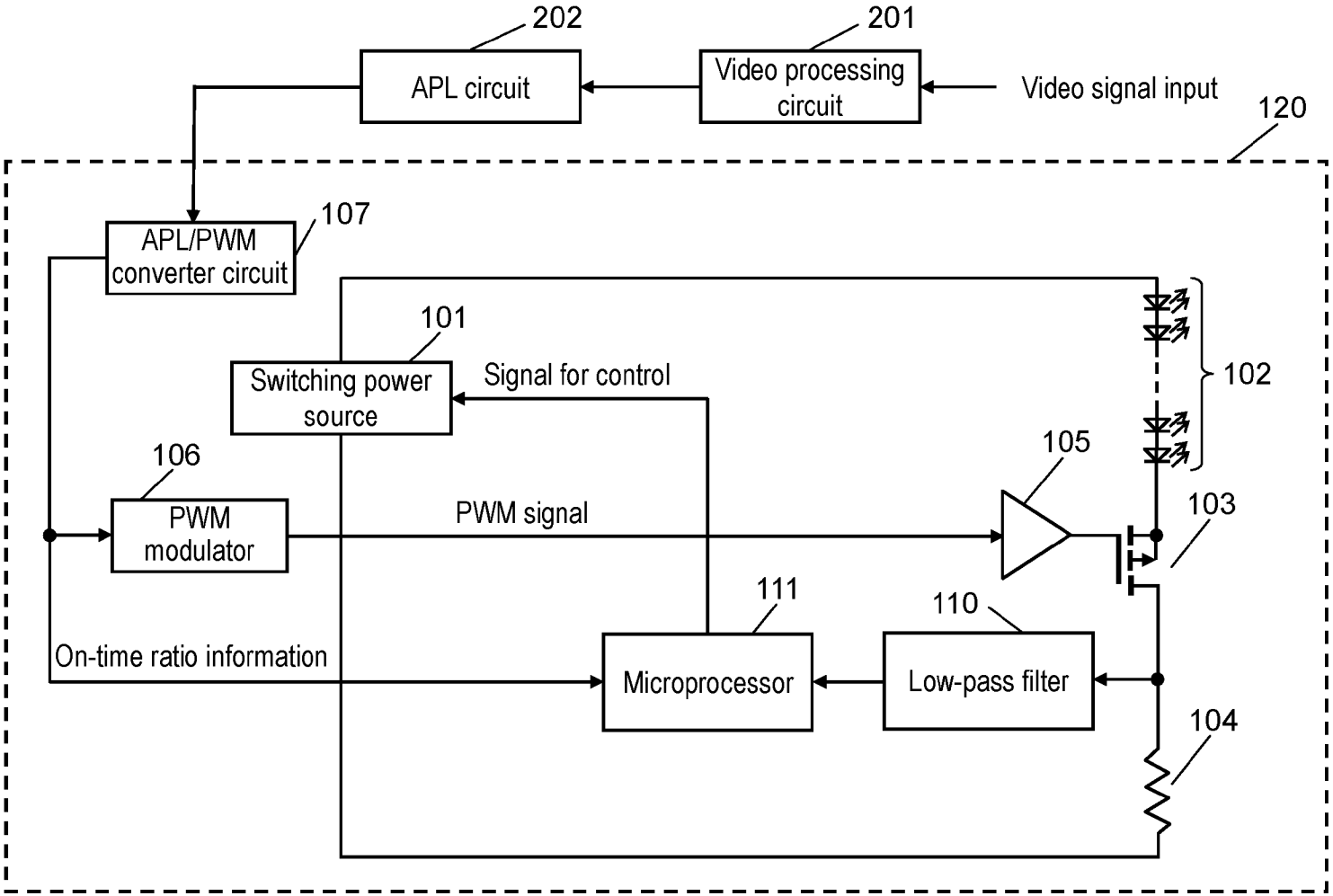
FIG. 4 is a main part block diagram illustrating the configuration of a semiconductor light source drive device according to the second exemplary embodiment.

First, a description is made of the configuration of semiconductor light source drive device 120 according to the second embodiment referring to the block diagram of FIG. 4.

FIG. 4 is a main part block diagram illustrating the configuration of semiconductor light source drive device 120 when used for a projection image display apparatus. The part enclosed by the broken line in FIG. 4 is semiconductor light source drive device 120 of this embodiment. The second embodiment is different from the first in that target value setting part 108 and comparator 109 in the first embodiment are implemented by one microprocessor 111 in the second embodiment. The other components are the same as those of the first embodiment, and thus their duplicate descriptions are omitted.

Specifically, in semiconductor light source drive device 120, microprocessor 111 is configured to receive an input of on-time ratio information from APL/PWM converter circuit 107 and an average current value from low-pass filter 110, to generate a signal for control on the basis of the input, and to control switching power source 101.

[2-2] Operation

A description is made of operation of semiconductor light source drive device 120 configured as above.

On-time ratio information for PWM control is input from APL/PWM converter circuit 107 to microprocessor 111. Microprocessor 111 calculates a target average current value corresponding to the on-time ratio for PWM control from on-time ratio information having been input. Microprocessor 111 compares the target average current value determined by calculation with the average current value from low-pass filter 110, and controls switching power source 101 so that these values become equal to each other. Through such an operation, the average value of a current flowing through semiconductor laser diode 102 is controlled for a value corresponding to the on-time ratio for PWM control being input. Here, microprocessor 111 may use a table corresponding to target table 108*a* described in the first embodiment that shows the correspondence between the on-time ratio for PWM control and the target average current value, for determining a target average current value.

The waveform of a current flowing through semiconductor laser diode 102 when FET 103 is on/off-controlled by a PWM signal is the same as that described in the first embodiment referring to FIG. 2.

The characteristics of the average value of a current when the on-time ratio is changed with the voltage output from switching power source 101 being constant are the same as those of FIG. 3. For microprocessor 111 to calculate a target average current value from an on-time ratio having been input, the characteristics of an actual semiconductor light source being driven shown in FIG. 3 are used. Such characteristics are those when voltage output from switching power source 101 is constant. Accordingly, if a current flowing through semiconductor laser diode 102 is feedback-controlled for a target average current value having been determined on the basis of this characteristic curve, the average value of a current flowing through semiconductor laser diode 102 accurately becomes a target average current value determined by microprocessor 111 correspondingly to the on-time ratio for PWM control being input. Besides, the voltage output from switching power source 101 can be made roughly constant except for the variation of the forward voltage of semiconductor laser diode 102.

A smoothing capacitor inserted to the output of switching power source 101 disables the output voltage value to be changed rapidly. When the voltage output from switching power source 101 is adjusted to control the average current for PWM control so as to maintain a constant value, time of approximately milliseconds is usually required before the output is stabilized. Meanwhile, semiconductor light source drive device 120 of the disclosure does not need to change the voltage output from switching power source 101, and thus is capable of stably supplying a current of a programmed waveform to semiconductor laser diode 102 rapidly.

Figure 5:
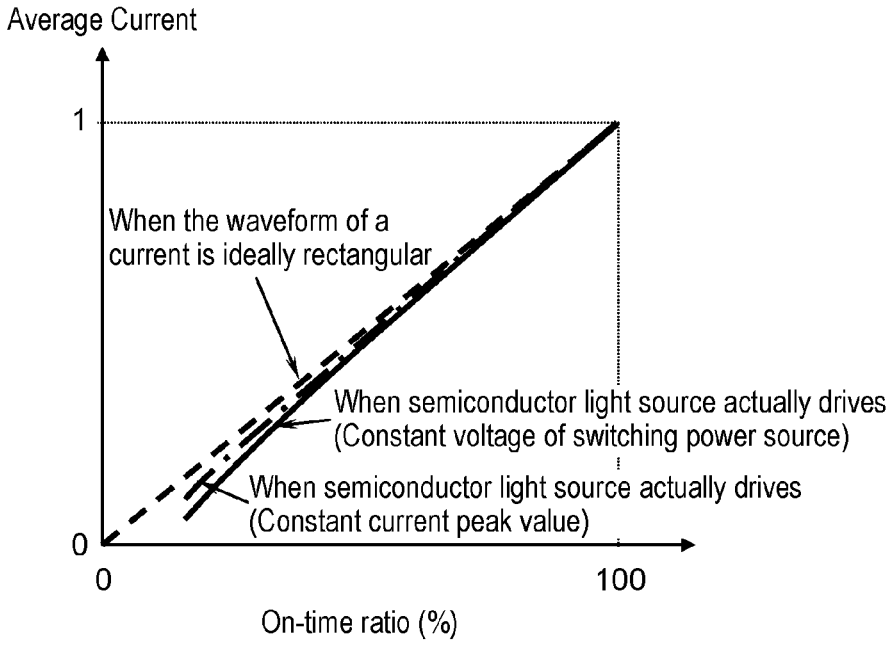
FIG. 5 is a characteristic diagram of the target value table used in the second embodiment.
Figure 6:
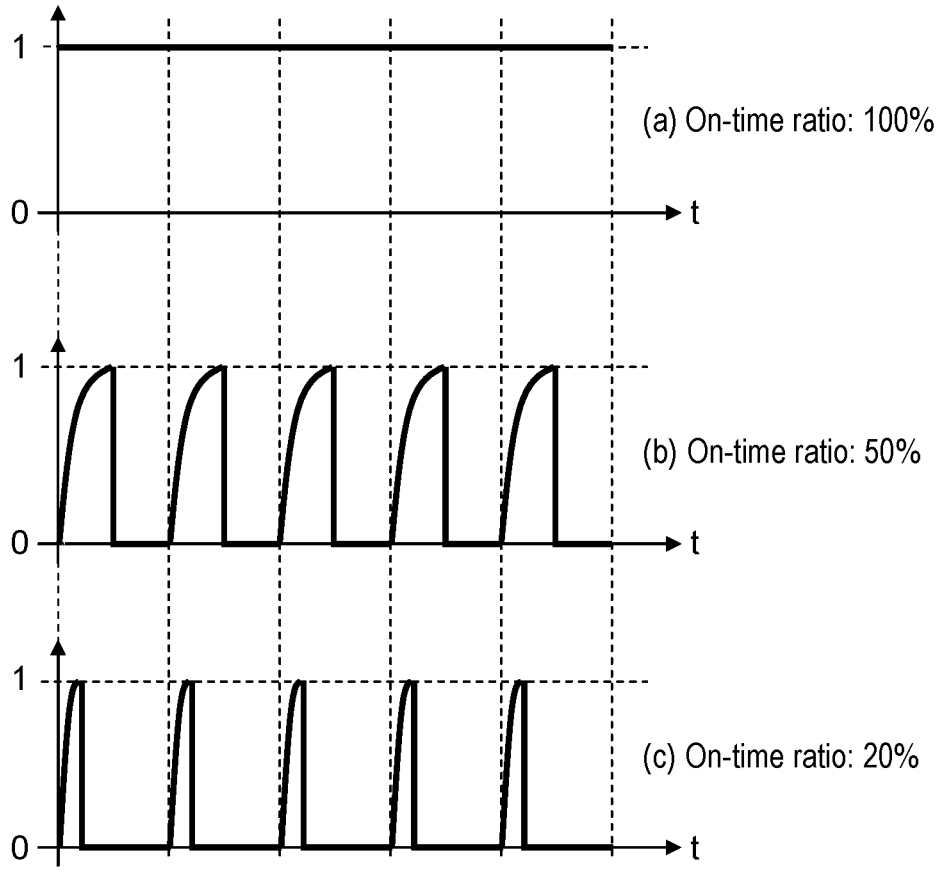
FIG. 6 is a waveform chart of a current flowing through a semiconductor laser diode for a constant current peak value of the second embodiment.

For microprocessor 111 to calculate a target average current value from an on-time ratio having been input, the characteristics for a constant current peak value shown in FIG. 5 can be also used, instead of the characteristics when an actual semiconductor light source is driven with the switching power source voltage shown in FIG. 3 being constant. For comparison, FIG. 5 additionally illustrates a characteristic curve for a constant voltage of the switching power source shown in FIG. 3. The case of a constant current peak value is a case where voltage output from the switching power source is controlled so that the maximum value (the peak value) of a current flowing through semiconductor laser diode 102 becomes constant regardless of the on-time ratio for PWM control, as shown in FIG. 6.

With the characteristics for a constant voltage of the switching power source, the maximum current value tends to be smaller for a smaller on-time ratio for PWM control as shown in FIG. 2. With the characteristics for a constant current peak value, the maximum current value (the peak value) is controlled to be constant for a smaller on-time ratio as shown in FIG. 6. Accordingly, as shown in FIG. 5, the average current value for a constant current peak value is larger than that for a constant voltage of the switching power source, approaching the characteristics of an ideally rectangular waveform of a current. Such characteristics resolve instability of optical output from the semiconductor laser diode generated for a small drive current.

Besides, a combination of control for a constant current peak value and that for a constant voltage of the switching power source can be used. Specifically, instability of optical output from the semiconductor laser diode generated for a small drive current occurs with a small on-time ratio for PWM control. Accordingly, the characteristics for a constant voltage of the switching power source are used for a large on-time ratio; the characteristics for a constant current peak value are used for a small on-time ratio. For example, the characteristics for a constant voltage of the switching power source are used for an on-time ratio of 30% or larger; those for a constant current peak value are used for an on-time ratio smaller than 30%, to determine a target average current value.

[2-3] Advantage

In this embodiment, the average value of a current flowing through semiconductor laser diode 102 is detected by current detection resistor 104 and low-pass filter 110. Then, microprocessor 111 compares this average current value with a target average current value calculated on the basis of an on-time ratio for PWM control being separately input, to control switching power source 101 for a target average current value that provides a constant voltage output from switching power source 101. Resultingly, the voltage output from switching power source 101 becomes roughly constant independently of the on-time ratio for PWM control, and thus the average current value rapidly converges to a programmed target average current value even if the on-time ratio for PWM control changes. Then, the average value of a current flowing through semiconductor laser diode 102 is stabilized owing to the effect of feedback. This rapidly stabilizes light output from semiconductor laser diode 102 depending on a current flowing through semiconductor laser diode 102.

Control performed for a constant peak value of a current flowing through semiconductor laser diode 102 resolves instability of optical output from semiconductor laser diode 102 generated for a small current flowing through semiconductor laser diode 102.

Other Exemplary Embodiment

Hereinbefore, the first and second exemplary embodiments are described to exemplify the technology disclosed in this patent application. The technology of the disclosure, however, is not limited to these embodiments, but is applicable to other embodiments devised through modification, substitution, addition, omission for example. Further, some components described in the first and second exemplary embodiments can be combined to create a new embodiment.

Hereinafter, another embodiment is exemplified.

In the first and second embodiments, a current sensing resistor is described as an example of a current detecting means. The current detecting means may be any element as long as it can detect a current, and thus is not limited to a current sensing resistor. A current sensing resistor, however, can detect a current with a simple circuit. Alternatively, a Hall sensor current detecting device may be used, which reduces a loss due to a current detection circuit.

Hereinbefore, the embodiments are described to exemplify the technologies in the disclosure. For this purpose, detailed descriptions and accompanying drawings are disclosed.

Accordingly, some components described in the detailed descriptions and accompanying drawings may include what is not essential for solving problems. Hence, the fact that such inessential components are included in the detailed descriptions and accompanying drawings does not mean that such inessential components are immediately acknowledged as essential.

The above-described embodiments are for exemplification of the technologies in the disclosure. Hence, the embodiments may undergo various kinds of change, substitution, addition, and/or omission within the scope of the claims and their equivalent technology.

What is claimed is:

1. A semiconductor light source drive device comprising:

a semiconductor light source;

a switching element controlling a current flowing through the semiconductor light source by being on/off-controlled by a PWM (pulse width modulation) signal provided to a control end;

a current detection element detecting a current flowing through the semiconductor light source;

a switching power source supplying power supply voltage to a series connection of the semiconductor light source, the switching element, and the current detection element;

a PWM supply circuit supplying the PWM signal and on-time ratio information about the PWM signal;

a target value setting part converting the on-time ratio information supplied from the PWM supply circuit to a target average current value and outputting the target average current value; and a comparator comparing the target average current value from the target value setting part with an average current value detected by the current detection element and outputting comparison output to the switching power source as a signal for control.

2. The semiconductor light source drive device of claim 1, wherein the target value setting part and the comparator are formed of one microprocessor.

3. The semiconductor light source drive device of claim 1, wherein the target average current value is determined on the basis of relationship between the on-time ratio information and the average current value for a constant power supply voltage of the switching power source.

4. The semiconductor light source drive device of claim 1, wherein the target average current value is determined on the basis of relationship between the on-time ratio information and the average current value for a constant peak value of a current flowing through the semiconductor light source.

5. The semiconductor light source drive device of claim 1, wherein the target average current value corresponding to the on-time ratio information for a given on-time ratio or larger is determined on the basis of relationship between the on-time ratio information and the average current value for a constant power supply voltage of the switching power source, and wherein the target average current value corresponding to the on-time ratio information for an on-time ratio smaller than the given on-time ratio is determined on the basis of relationship between the on-time ratio information and the average current value for a constant peak value of a current flowing through the semiconductor light source.

* * * * *